United States Patent [19]

Tamm et al.

[11] Patent Number: 4,592,788

[45] Date of Patent: Jun. 3, 1986

[54] METHOD FOR PRESSURIZED WATER QUENCHING OF ROLLED STEEL PRODUCTS

[75] Inventors: Franz Tamm, Hennigsdorf; Bernhard Hoericke, Falkensee; Arnold Joachim, Hennigsdorf, all of German Democratic Rep.

[73] Assignee: VEB Stahl- und Walzwerk "Wilhelm Florin", Hennigsdorf, German Democratic Rep.

[21] Appl. No.: 703,643

[22] Filed: Feb. 21, 1985

[30] Foreign Application Priority Data

Dec. 21, 1984 [DD] German Democratic Rep. ..... 2714355

[51] Int. Cl.[4] ..... C21D 7/10

[52] U.S. Cl. ..... 148/12 B; 148/12.4

[58] Field of Search ..... 148/12 B, 12.4

[56] References Cited

U.S. PATENT DOCUMENTS

| | | | |
|---|---|---|---|
| 4,016,009 | 4/1977 | Economopolous et al. | 148/12 B |
| 4,046,599 | 9/1977 | Economopolous | 148/12 B |
| 4,108,695 | 8/1978 | Paulitsch et al. | 148/12 B |
| 4,146,411 | 3/1979 | Dewsnap et al. | 148/12 B |
| 4,175,985 | 11/1979 | Blandelot et al. | 148/12 B |
| 4,180,418 | 12/1979 | Paulitsch et al. | 148/12 B |

FOREIGN PATENT DOCUMENTS

| | | | |
|---|---|---|---|
| 132355 | 9/1978 | Fed. Rep. of Germany | 148/12.4 |
| 135917 | 6/1979 | Fed. Rep. of Germany | 148/12 B |
| 137729 | 9/1979 | Fed. Rep. of Germany | 148/12 B |
| 2916218 | 10/1980 | Fed. Rep. of Germany | 148/12 B |
| 148723 | 11/1980 | Japan | 148/12.4 |
| 9920 | 1/1983 | Japan | 148/12 B |

*Primary Examiner*—Wayland Stallard

*Attorney, Agent, or Firm*—Jordan and Hamburg

[57] ABSTRACT

A method for pressurized water quenching of rolled steel products wherein the product is cooled so abruptly on its surface, at a quenching from a final rolling temperature of approximately 1000° C. to an equilibrium temperature of above 500° C., the temperature of the core immediately after the completion of the quenching is no more than only 30° C. below the original final rolling temperature. The shorter cooling periods lead to a thinner martensitic layer, and a greater portion of the ferritic-perlitic core mass resulting in an increase in ductility with little change in strength.

3 Claims, No Drawings

METHOD FOR PRESSURIZED WATER QUENCHING OF ROLLED STEEL PRODUCTS

The invention is applicable in metallurgy to the production of rolled steel products pressurized utilizing water quenching. The main field of application is in the production of thermally hardened reinforcing steels for concrete.

BACKGROUND OF THE INVENTION

Methods for pressurized water quenching of rolled materials have become known since the beginning of the nineteen sixties. According to DE-PS 84 615, after the last stage of a rolling mill, a water quenching of reinforcing steel for concrete at a final temperature of approximately 1000° C. of the rolled material to an equilibrium temperature of approximately 650° C. is performed, whereby at the end of the cooling period, the core temperature is reduced to approximately 800° C. and the peripheral temperature of the rolled material is approximately 150° C. DE-AS 23 53 034 describes a similar method. However, it states that upon abrupt cooling, the core temperature after the pressurized water quenching is still at approximately 850° C. DE-AS 24 39 784 discloses the cooling of ribbed reinforcing steel for concrete, which is cooled at a rate of at least 1000° C./s in one stage to a peripheral temperature of 100° to 300° C. and subsequently tied into bundles.

DE-PS 24 26 920 and DE-PS 29 00 271 also relate to the production of reinforcing steel for concrete by means of intensive water cooling; however, neither core temperatures nor cooling rates are specified.

In the first three mentioned published patent specifications, values for the cooling forces are specified, which have been attained in the pressurized water cooling of ribbed reinforcing steel or wire for concrete.

Although the strength values obtained with the known methods of pressurized water quenching of rolled steel products are sufficient, the ductility values barely reach the minimum permissible required limit values. The present trend towards higher ductility values can no longer be met with presently known methods.

SUMMARY OF THE INVENTION

The object of the invention is to improve the utility values of thermally hardened rolled steel products, particularly of reinforcing steels for concrete, and to extend the field of application of these steels.

The invention involves changing the cooling parameters of a method for pressurized water quenching of rolled steel products so that, although the strength characteristics remain the same, the ductility values are improved. Thus, in accordance with the invention the rolled steel product is quenched so abruptly on its surface, that at a quenching from a final rolling temperature of approximately 1000° C. to an equilibrium temperature of above 500° C., the temperature of the core immediately after completion of the quenching is no more than only 30° C. below the original final rolling temperature.

During such abrupt quenching there occur borderline conditions, whereby the heat transfer conditions substantially inhibit further temperature decrease of the core.

The advantages of such a method consist in that the low peripheral temperatures cause an improved martensitic structure in the peripheral zones. The shorter cooling periods lead to a thinner martensitic layer, with the portion of the ferritic-perlitic core mass increasing at an extremely small portion of the transitional zone between ferritic-perlitic core mass and the highly tempered martensitic peripheral layer.

The invention will be further explained by means of the following example.

EXAMPLE

A ribbed reinforcing steel for concrete of a diameter of 12 mm was quenched at a relative speed of 15 m/s between rolling material and cooling medium. The temperature decrease of the core immediately after the completion of the quenching from a final rolling temperature of approximately 1000° C. under these conditions of heat transfer amounted to approximately 20° C., whereby after the auto-tempering, the reinforcing steel for concrete had a temperature of approximately 600° C. In a comparative example, the relative speed of quenching was reduced to 7 m/s, i.e., the cooling period was correspondingly prolonged. In this example, an equilibrium temperature of approximately 600° C. was again attained.

It was found that the steel which was quenched at a relative speed of 15 m/s between the rolled material and the cooling medium possessed a ductility which was 20% higher than that of the steel quenched at a relative speed of 7 m/s, although the resulting strengths of the two steels were almost the same.

An examination of the structure of the more rapidly quenched steel showed that the increased portion of the ferritic-perlitic core mass corresponds approximately to the percent increase in ductility.

We claim:

1. A method for the pressurized water quenching of rolled steel products, whereby the residual heat remaining in the core causes an auto-tempering of the quenched peripheral layer, comprising quenching the rolled steel product so abruptly on its surface that at a quenching from the final rolling temperature of approximately 1000° C. to an equilibrium temperature of over 500° C., the temperature of the core immediately after completion of the quenching is no more than approximately 30° C. below the original final rolling temperature.

2. The method of claim 1, wherein the quenched steel has a higher ductility than a steel quenched less abruptly.

3. The method of claim 1, wherein the quenched steel has a higher proportion of ferritic-perlitic core mass than a steel quenched less abruptly.

* * * * *